US010443989B1

(12) United States Patent
Edwards

(10) Patent No.: US 10,443,989 B1
(45) Date of Patent: Oct. 15, 2019

(54) BALLISTIC PROJECTILE TARGET BASE WITH TRANSITIONAL TARGET IMAGE, AND METHOD OF MAKING SAME

(71) Applicant: Allen W. Edwards, Estero, FL (US)

(72) Inventor: Allen W. Edwards, Estero, FL (US)

( * ) Notice: Subject to any disclaimer, the term of this patent is extended or adjusted under 35 U.S.C. 154(b) by 0 days.

(21) Appl. No.: 16/195,062

(22) Filed: Nov. 19, 2018

Related U.S. Application Data

(60) Provisional application No. 62/761,669, filed on Apr. 3, 2018.

(51) Int. Cl.
*F41J 5/24* (2006.01)

(52) U.S. Cl.
CPC ..... *F41J 5/24* (2013.01)

(58) Field of Classification Search
CPC ..... F41J 5/24
USPC ..... 273/378, 403–408
See application file for complete search history.

(56) References Cited

U.S. PATENT DOCUMENTS 1,093,171 A * 4/1914 Buell ..... F41J 1/01 273/378
3,423,092 A * 1/1969 Kandel ..... F41J 1/01 273/378
3,512,778 A * 5/1970 Allen ..... F41J 3/0004 273/403
3,895,803 A * 7/1975 Loe ..... F41J 1/01 273/378
3,899,175 A * 8/1975 Loe ..... F41J 1/00 273/378
4,810,561 A * 3/1989 King ..... B32B 15/04 428/195.1
4,921,256 A * 5/1990 Gearhart ..... F41J 1/01 273/378
5,186,468 A * 2/1993 Davies ..... F41J 1/01 273/378
5,188,371 A * 2/1993 Edwards ..... F41J 1/01 273/378
5,275,890 A * 1/1994 Wolf ..... B32B 27/10 428/514
5,501,467 A * 3/1996 Kandel ..... F41J 1/01 273/378
5,580,063 A * 12/1996 Edwards ..... F41J 1/01 273/378
6,019,375 A * 2/2000 West, Jr. ..... F41J 1/01 273/378

(Continued)

*Primary Examiner* — Mark S Graham
(74) *Attorney, Agent, or Firm* — William E. Noonan

(57) ABSTRACT

An impact marking target includes a base. A transitional target image carried by a front surface of the base includes a halo-defining portion having a highly visible first color. Transitional target indicia formed against the halo-defining portion have a second color that contrasts with the first color for marking discrete regions of the transitional target image. The transitional target image includes an ink that is permanently bonded to and not dislodgeable from the front surface of the base. An exterior target image is applied over the base covering the transitional target image. The exterior target image includes a dislodgeable ink having a third color that contrasts with the first color. The exterior target image also includes exterior target indicia that positionally correspond with the transitional target indicia. A transparent film is interposed between the halo-defining portion and the exterior target image.

14 Claims, 14 Drawing Sheets

(56) References Cited

U.S. PATENT DOCUMENTS

| | | | | |
|---|---|---|---|---|
| 8,596,643 | B1 * | 12/2013 | Edwards | F41J 5/00 273/378 |
| 9,170,077 | B2 * | 10/2015 | Johnson | F41J 5/24 |
| 9,625,239 | B2 * | 4/2017 | Flynn | F41J 5/205 |
| 9,857,150 | B1 * | 1/2018 | Larson | B05C 1/00 |
| 2007/0046760 | A1 * | 3/2007 | Zara | F41J 1/00 347/105 |
| 2009/0058008 | A1 * | 3/2009 | Baumgartner | B29C 51/10 273/408 |

* cited by examiner

BALLISTIC PROJECTILE TARGET BASE WITH TRANSITIONAL TARGET IMAGE, AND METHOD OF MAKING SAME

RELATED APPLICATION

This application claims the benefit of U.S. Provisional Patent Application Ser. No. 62/761,669 filed Apr. 3, 2018.

FIELD OF THE INVENTION

This invention relates to an improved target base for an impact marking ballistic target featuring embedded target indicia that remain visible within the halo produced by a projectile striking the impact marking target so that the point of impact may be more accurately determined.

BACKGROUND OF THE INVENTION

Various impact reflecting targets are available for use with firearms and other diverse projectile propelling devices. See my U.S. Pat. Nos. 5,188,371, 5,580,063 and 8,596,643. Such ballistic targets allow sport shooters and marksmen to improve their visual sighting of a projectile's point of impact on the target and therefore better determine their shooting accuracy and skill. Known impact marking targets typically employ a substrate or base that carries a layer of photoreflective ink having a highly visible color such as, but not restricted to, yellow or red. This photoreflective ink layer is covered by a thin film, which may include, but is not limited to bi-axially oriented polypropylene. A target image is applied over and on top of the film. When a bullet or other projectile strikes the target, the impact produces a penetration halo, which is the result of the displacement of ink pigment particles from the projectile impact area due to the effect caused by the shock waves generated by the projectile impact. This reveals the underlying photoreflective color and thus marks the point of impact.

Conventional targets featuring the foregoing technology, such as for example, Shoot-N-C targets manufactured by Birchwood Casey, are quite popular and fulfill most of the standard target requirements of sport shooters. Nonetheless, such targets fail to provide a permanent and sufficiently accurate indication of the specific location or coordinates on the target which are struck by the projectile. Superior, highly accurate markings are especially desirable in shooting and firearms competitions where the focus is on maximum precision marksmanship over a wide range of shooting distances. Improved precision impact markings are also needed for police and military training and when conducting target practice. Unfortunately, known impact marking targets are often unable to record the precise point of projectile impact with the accuracy required for such uses. The desired convenience of the shooter being able to easily see the ballistic projectile impact location is offset by the inherent problems caused by the sizable "halo" or "corona" effect, which occurs when the projectile strikes the target. This does allow the user to almost instantly determine the general area of the target where the bullet or other projectile has struck. However, certain portions of the printed target location identifying visual coordinates or indicia of the impact marking target, such as edges of a bullseye, target rings, alphanumeric designations and other graphic images are often obliterated when the projectile strikes the target and portions of the target ink are dislodged to reveal the underlying photoreflective color. As a result, it can be very difficult, if not impossible, to satisfactorily and precisely determine where the projectile has struck the target relative to the disrupted coordinates, markings or other location identifying indicia of the target. This is particularly problematic in shooting competitions and civilian, military and police firearms training applications as described above.

U.S. Pat. No. 9,857,150 attempts to provide an improved visual indication of the precise location where a projectile strikes an impact marking target. However, that reference teaches a complex and expensive method of target construction wherein at least five or more layers of coatings comprising clay, cardboard and ink are assembled and arranged in a rather tedious and intricate manner. This requires a very sophisticated level of production expertise and results in a considerable production unit manufacturing cost. I have determined that the need exists for a far simpler, less expensive and much more precise and effective impact marking target, which can be manufactured more quickly, conveniently and at far less per unit expense and which overcomes the foregoing problems associated with known impact marking targets.

SUMMARY OF THE INVENTION

It is therefore an object of the present invention to provide an improved ballistic projectile impact marking target base featuring a transitional target image that allows the location of projectile impacts to be more precisely and accurately recorded;

It is a further object of this invention to provide an impact marking target base featuring transitional impact-calibrating indicia that are not dislodged or obliterated when a bullet or other projectile strikes the target so that much more accurate shooting results showing target indicia coordinates are provided for ballistic projectile impact indicating targets;

It is a further object of this invention to provide a ballistic projectile target base with a transitional target image, which will replace the perennial standard target base that is normally used as a platform for providing a surface to support a conventional ballistic projectile impact marking target.

It is a further object of this invention to provide a ballistic projectile target base with a transitional image, which replaces the standard conventional target base and provides an integrated platform incorporating a generic conventional ballistic impact marking target featuring many standard features that facilitate industry adoption of the new technology disclosed herein.

It is a further object of this invention to provide a ballistic projectile target base featuring a transitional target image that may be combined with a generic conventional ballistic impact marking target to create a complete and unified ballistic projectile impact marking target that rectifies the fundamental shortcomings of existing impact marking target technology and which particularly provides for improved calibration and measurement of the position of projectile impact coordinates shooting results;

It is a further object of this invention to facilitate the accurate reading and recording of projectile strikes by clearly and precisely indicating their proximity to predetermined target reference coordinates or indicia including, but not limited to bullseye locations or other graphic representations;

It is a further object of this invention to provide an impact marking target that is much more effective than existing targets presently in use by shooting enthusiasts in firearms competitions, and in police, military and firearms training application where greater degrees of verifiable coordinated shooting accuracy are required;

It is a further object of this invention to provide an impact marking target that permits improved accurate and calibrated measurements of shooting results to be taken using an impact marking target that utilizes fewer structural components and is much simpler and less expensive to manufacture than other existing targets;

It is a further object of this invention to provide an impact marking target that successfully addresses and remedies the existing problem of graphic target indicia and coordinates being obliterated on impact marking targets due to the displacement of target graphic image ink surrounding the projectile impact point and the halo or corona that is typically formed when a projectile strikes the target.

It is a further object of this invention to provide the option of an impact marking target that eliminates the color of the halo-defining portion from the exterior target image so that the impact halo is more visibly delineated from the external target image than in conventional targets.

This invention features an impact marking target including a base having front and back surfaces. A transitional target image is carried by the front surface of the base. The transitional target image includes a non-detachable halo-defining portion that has a highly visible first color. The transitional target further includes transitional target indicia formed against the halo-defining portion and having a second color that contrasts with the first color for marking discrete regions of the transitional target image. The transitional target image includes non-dislodgeable permanent ink. An exterior target image is applied over the transitional target image. The exterior target image includes a dislodgeable ink portion having a third color that contrasts with the first color of the transitional target image. The exterior image further includes exterior target indicia that positionally correspond or register with the transitional target indicia for marking discrete regions of the existing target image. The exterior target image is otherwise devoid of the first color. A transparent low dyne film is interposed between the halo-defining portion of the transitional target image and the dislodgeable ink of the exterior target image. As a result, a projectile striking the impact marking target removes the dislodgeable ink of the exterior target image around the point that the projectile impacts the exterior target image. This exposes an underlying portion of the transitional target image including any transitional target indicia within that underlying portion. The ability to view and clearly delineate the transitional target indicia against the halo-defining portion is possible as the result of the optically transparent clear film applied to the transitional target image, which creates a portal, or window, through which portions of the transitional target image are readily viewable within the parameter of the detached ink particles, by virtue of the projectile impact generated corona or halo effect.

In a preferred embodiment, the transitional target indicia may be applied directly against the halo-defining portion. In such versions, the transparent film is applied over the transitional target image and interposed between the transitional target image and the exterior target image. The base may include a pressure sensitive adhesive label that carries an adhesive on the back surface thereof. The adhesive may be covered by a removable backing. Either a reflective base coat or a transitional target image may be applied to the outer surface of the pressure sensitive label, which may then be subsequently assembled and completed in the manner described in my previously referenced patents. A print coat may be carried by the front surface of the base for supporting the transitional target image thereon. The print coat may include the first color and the transitional target indicia may be formed against the print coat.

The transitional and exterior target indicia may include but are not restricted to, images featuring a bullseye and surrounding concentric rings. Various other indicia, coordinates, matrices alpha-numeric designations and graphic designs may also be employed.

The halo-defining portion may be defined by the print coat carried by the front surface of the base. The transitional target indicia may be printed on or otherwise applied to the print coat. In other versions a negative target image may be formed with openings in the halo-defining print coat portion that expose underlying transitional target indicia.

The transitional target image may include a positive image wherein the transitional target indicia are printed or otherwise formed against the halo-defining portion. Alternatively, the transitional target image may include a negative image formed in the halo-defining portion. The transitional target image may be permanently bonded to the base such that portions of the transitional target indicia adjacent to the impact point resist removal when a projectile impacts the target. Likewise, the halo-defining portion may be permanently bonded to the base such that the parts of the halo-defining portion adjacent to the impact point resist removal due to a projectile strike.

In alternative preferred embodiments, the transparent film may be interposed between the halo-defining portion and the transitional target indicia of the transitional target image such that portions of the transitional target indicia adjacent to the impact point similarly resist removal when a projectile impacts the target. In such versions the transitional target indicia may include a positive image comprised of the second color. In such embodiments, the exterior target indicia may include a negative image formed in the displaceable ink, which registers with the transitional target indicia to display the transitional target image indicia through the negative image of the exterior target image.

This invention also features methods of manufacturing an impact marking target and target base according to this invention. One method involves providing a base having front and back surfaces with the front surface including a halo-defining portion that includes a high visibility first color. A transitional target image is formed on the front surface of the base by applying transitional target indicia to the halo-defining portion. Such indicia have a second color that contrasts with the primary color for marking discrete regions of the transitional target image. A transparent film having a top surface is juxtaposed against the front surface of the base such that the transitional target image is interposed between the base and the film. An exterior target image is applied to the top outer surface of the film. The exterior target image and the transitional target image are substantially aligned and congruent with one another. The exterior target image is applied as a dislodgeable ink having, but not restricted to, a third color that contrasts with the first color. The exterior target image is composed to be otherwise devoid of the first color. The transitional target image is further provided with an exterior target indicia that preferably positionally correspond with the transitional target indicia. The transitional target indicia may be formed against the highly visible first color of the halo-defining portion by forming the indicia as either a positive or negative image.

An alternative method provides a base having front and back surfaces with the front surface including a halo-defining portion that includes a highly visible first color. A transparent film is applied on top and over the reflective base coat. Permanent non-transitional target indicia are formed on the front surface of the transparent film. Such displaceable indicia have a second color that contrasts with the first color for marking discrete regions of the transitional target image. An exterior target image is applied to the front outer surface of the film. The exterior target image includes exterior target indicia that are substantially aligned and congruent with the transitional target indicia. The exterior target image is applied utilizing a dislodgeable ink having a third color that contrasts with the first color. The transitional target indicia may be formed against the highly visible first color of the halo-defining portion by forming the indicia as either a positive or negative image.

DETAILED DESCRIPTION OF PREFERRED EMBODIMENTS

Figure 1:
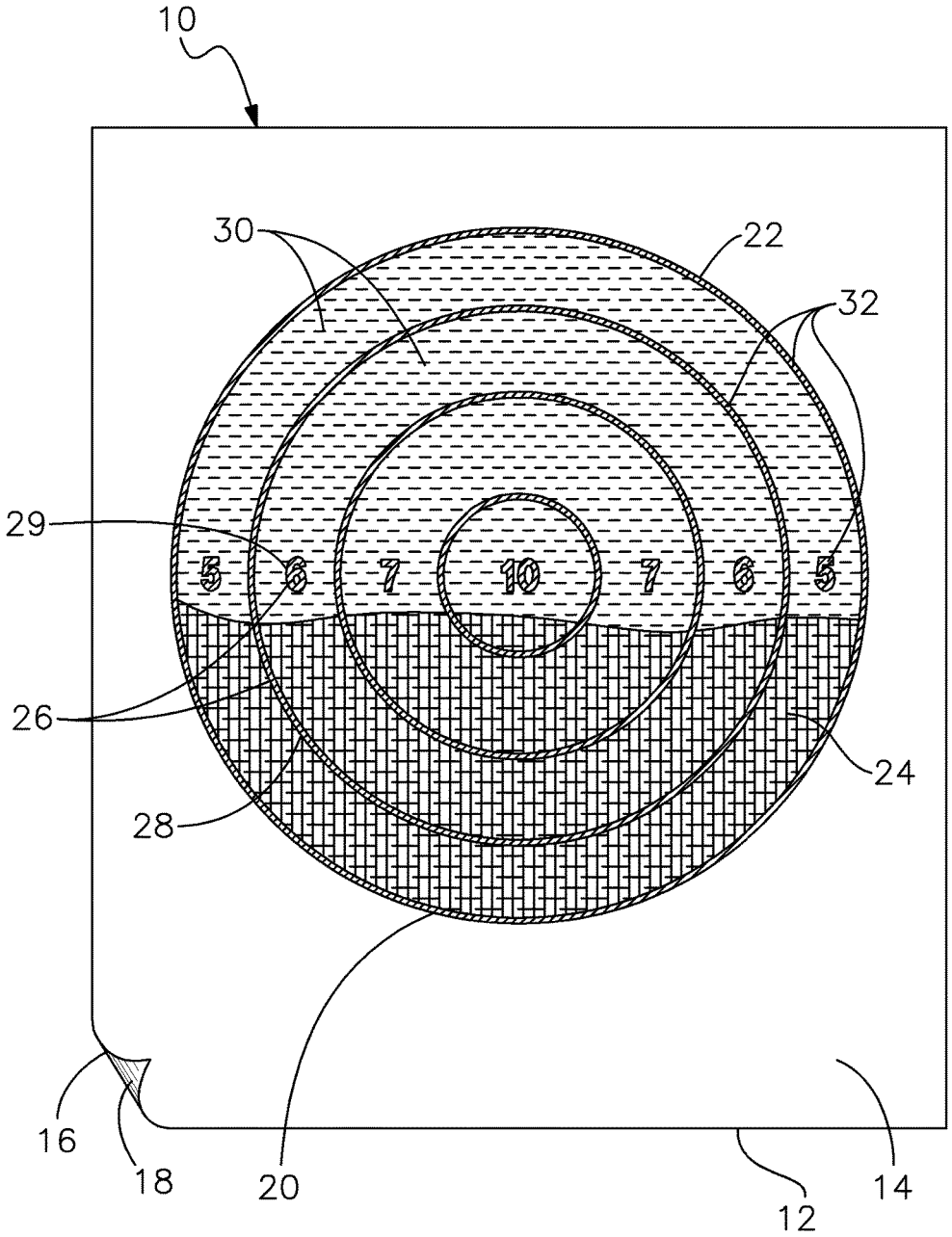
FIG. 1 is an elevational front view of a first preferred impact marking target having matching transitional and exterior target images formed thereon in accordance with this invention; the exterior target image is partially cut away to illustrate the underlying transitional target image printed on the target base.

The invention disclosed herein addresses and resolves the shortcomings that currently result from the failure of conventional ballistic impact marking targets to accurately record the proximity of projectile strikes or impacts relative to impact marking or calibrating coordinates or indicia that are normally printed or otherwise formed on the target. Such coordinates or indicia may comprise, but are not limited to the lines of a standard bullseye that separate the target into discrete regions. The target indicia may also comprise graphic lines or regions which represent the target at which the shooter is aiming and shooting (e.g. animals, humans and assorted inanimate objects as well as parts or regions of such representations). The displayed target indicia may also comprise various other forms of graphic matrices, coordinates, alpha numeric designations, colors, shapes, etc. The particular type of graphic representation defined by the target indicia is not a limitation of this invention. It should be understood that, as used herein, "target indicia" refers to and includes all of the foregoing graphic representations. Such indicia allow the shooter to more accurately calibrate or measure the proximity of the projectile penetration hole or impact point in proximity to the indicia. This, in turn, enables the shooter to more accurately determine the precise point or location at which the ballistic projectile strikes the target. The transitional target indicia likewise transition from a hidden to exposed condition when a projectile impact removes the dislodgeable ink from the exterior target image.

According to known impact marking target technology, when the projectile strikes the target image, the ink surrounding the projectile penetration point is dislodged from the target by reason of the projectile impact shock wave. This produces a halo or corona (hereinafter simply "halo") that enables the shooter to better see the general location of the impact. However, the portions of the target indicia formed within the dislodged ink area are also obliterated by the impact, making accurate calibration of the projectile strike quite difficult.

The present invention overcomes the foregoing problem by employing a very simple and efficient method to assemble transitional target image employing transitional target indicia that preferably match the exterior target indicia. Following projectile impact, permanently bonded transitional target indicia proximate to or intersecting the point of projectile penetration are not dislodged and remain clearly visible within the impact halo. This provides the shooter with a compensatory reference point on the target and accurately informs the shooter of the degree of aim adjustment, if any, that is required to more accurately direct and shoot subsequent bullets or other projectiles at the target. It should be understood that as used herein, the term "transitional" refers to the fact that during use of the impact marking target, the transitional target image "transitions" from being at least partially hidden prior to projectile impact to being at least partially exposed as each projectile strikes the target. The transitional target indicia likewise transitions to a condition wherein such indicia are displayed very clearly against a contrasting color halo when a projectile impact removes the dislodgeable ink from the exterior target image. The transitional image is, by design, viewable in its original graphic size, utilizing a compatible color of design, so that the transitioned indicia revealed in the halo portal are legible, but non obtrusive. The transitional image therefore has a minimal effect on the desired reactive visibility sighting of the projectile impact by the target user at various range shooting distances.

For purposes of clarity, the drawings described herein illustrate the invention as used in an impact marking target featuring a traditional "bullseye" design. However, as previously described, alternative graphic designs and forms of indicia may be employed within the scope of this invention.

There is shown in FIGS. 1 and 2A-2C an impact marking target 10 including a bottom, sheet-like substrate or base 12. Base 12 includes a front surface 14 and a rear surface 16, FIGS. 2A, 2B and 2C. The base is most commonly composed of a basic paper stock that is prepared with standard graphics industry surface preparation specifications in order to support printing thereon. When paper stock is employed, that paper may have a weight of 40 lbs although various other weights may be utilized. Other optionally printable materials such as pressure sensitive adhesive labels may be utilized for the base. In such cases, the paper may be composed of a lightweight material (e.g. 10 lb. stock) which is removably attached to a disposable backing support paper. For example, in FIG. 1 adhesive backing 18 is attached to back surface 16 of base 12. The adhesive backing allows the impact marking target to be attached to and supported by various suitable rigid target support surfaces (e.g. walls, posts, trees, placards etc.). In lieu of paper labels, the base may comprise other materials including fabric, plastic or metal stock. It should also be understood that the base may have a wide variety of shapes and sizes, which do not comprise limitations of this invention.

A target intended for outdoor use may require a base paper weight of 80 lbs. or more, which allows the target to withstand ambient wind velocity conditions. Extreme environmental conditions may dictate the use of a suitable metallic base. Targets typically used in indoor shooting ranges would normally require a weight of about 40 lbs. Heavier, stronger and more durable target bases are suitable for use when larger caliber ballistic projectiles are directed at the target. For example, if a .50 caliber projectile is involved, a more substantial rigid target base composed of cardboard or metal may be required. Again, the composition, size and shape of the target base may be varied within the scope of this invention.

As further shown in FIG. 1, front surface 14 of target base 12 supports a transitional target image 20 and a matching exterior target image 22 comprising a conventional impact dislodgeable ink. Half of image 22 is cut away in FIG. 1 to fully illustrate the underlying transitional target image 20. Transitional target image 20 includes a halo-defining portion 24 (see also FIGS. 2A-C and 3), which is composed of a highly visible (in this case yellow) first color. The halo-defining portion should comprise a brightly colored, reflective background image, flood coat or optional graphic design. A vendor-supplied neutral factory finish standard, such as, but not restricted to white, may also be utilized as a production cost saving factor. However, the lower reflective visibility of such a neutral color may detract from the expected high visibility performance of the target over longer shooting distances. The transitional target image also includes transitional target indicia 26, FIGS. 1-3, which include the thin annular lines 28 defining the rings of the bullseye image and the collective numerals 29 that designate the respective discrete regions of the bullseye. In the disclosed embodiment, those regions are marked by respective numerals 5, 6, 7 (representing concentric annular regions of the target) and 10 (representing the circular center or bullseye of the target). The preferred manner of manufacturing target indicia 28 and 29 is disclosed below.

By the same token, exterior target image 22 includes a concentric series of annular regions 30 that are defined by a removable or dislodgeable black ink of the type used for conventional impact marking targets. Exterior target image 22 also defines indicia 32 formed by what appears to be a visual sighting of numerals 29 (5, 6, 7 and 10) and annular lines 28. These numerals and annular lines are created by implementing a graphic reverse image of rings 28 and numerals 29 to produce a reverse, or negative image format. In this manner, any and all indicia required for comparative analysis are visually available through the "window" of the reverse image printing technique on the surface of the exterior target image 22. The degree and manner of such reverse image effect is controlled by the artistic specifications of the graphic image design being utilized, consistent with any prevailing standards, on an individual basis for each graphic.

In order to achieve an optimal result, it is necessary to ensure that the graphic image and indicia of the transitional target image 20 precisely registers with the corresponding graphic image and indicia of the exterior target 22. As used herein, the term "register" should be interpreted to include matching or conforming in shape. Indicia 32 of exterior target image 22 correspond positionally with the underlying indicia 26 of transitional target image 20. The outer circumference of exterior target image 22 precisely conforms to and registers with the outermost annular ring 28 of the transitional target image. The circumferential edge of the exterior target image and the annular region immediately adjacent thereto are likewise deemed exterior target indicia within the scope of this invention. In all embodiments of this invention the outermost transitional indicia ring 28, which conforms to the outer circumference of the exterior target image, is deemed registered with the exterior target indicia. Again, the manner of manufacturing the matching indicia of the exterior target image and underlying transitional target image is described below.

Figure 3:
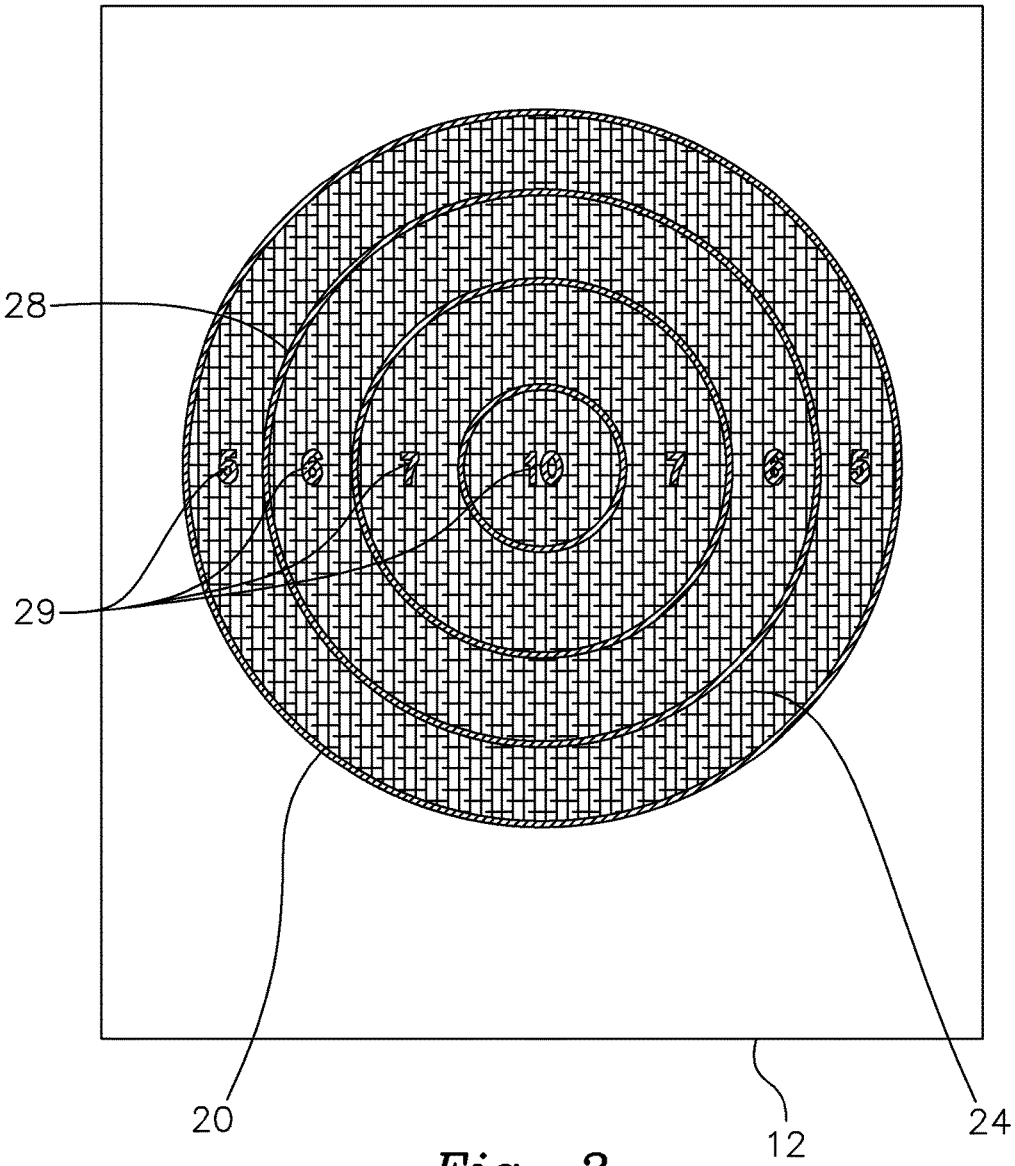
FIG. 3 is an elevational front view of the target base of FIG. 1 with the transitional target image and the transitional target indicia formed as a positive image.

Transitional target image 20, which is shown mounted by itself to target base 12 in FIG. 3, may be formed in a number of ways. For example, one or more ink print coats comprising, but not limited to yellow or another highly visible color, preferably in the fluorescent spectrum zone, may be applied using conventional printing techniques to the upper surface 14 of target base 12. Yellow is preferred due to its high degree of photo reflectivity and visibility, which makes it particularly effective for use in ballistic target practice and shooting competitions. High visibility colors tend to produce the most favorable halo effect. In alternative embodiments, the halo-defining region of the transitional target image 20 may be provided by employing the blank factory "mill" finish of the typically paper target base. This mill finish may be, but is not necessarily limited to, the color white. Yellow or even more highly visible colors are preferred because they provide a better "halo" effect, particularly when the shooting distances are significant. The print coat may be applied as a flood coat graphic design, or otherwise across the entire expanse of the target base. Alternatively, as shown in FIG. 3, a circular print coat may be applied to form the halo-defining region 24. In all versions of this invention, it is critical that the halo-defining portion be permanently bonded to the underlying surface 14 of target base 12. This allows an impact halo to be formed surrounding the point at which the projectile strikes the target.

Figure 2A:
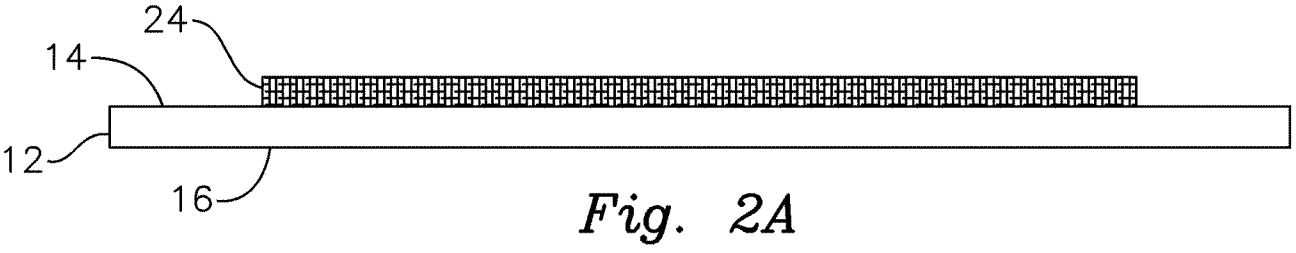
FIG. 2A is a side, cross sectional view of the target base of FIG. 1 with a print coat layer comprising a highly visible first color forming a halo-defining portion that is bonded to the base.
Figure 2B:
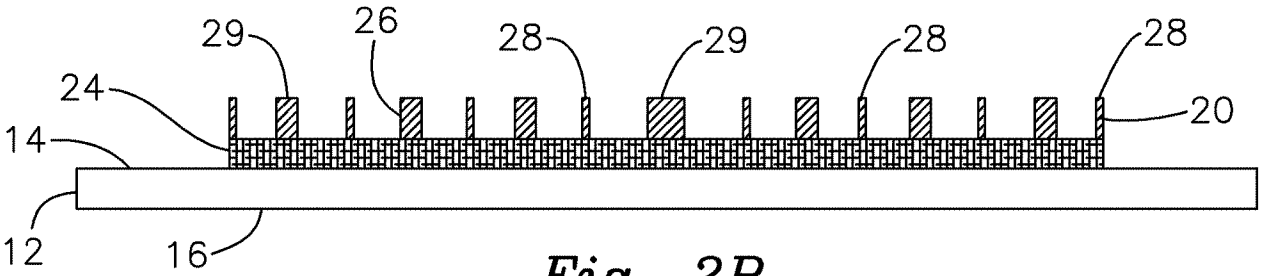
FIG. 2B is a side cross sectional view of the target base of FIG. 1 with the print coat and the transitional target indicia permanently bonded to a front face of the target base.

After halo-defining portion 24 is formed on front surface 14 of base 12, the previously described transitional target indicia 26 are printed or otherwise formed on the halo-defining portion 24 in the manner shown in FIGS. 2B and 3. Specifically, annular lines or rings 28 and numerals 29 are printed on the yellow or otherwise highly visible portion 24 to separate transitional target image 20 into discrete target regions. The ink comprising transitional target indicia 28 and 29 includes a second color that contrasts with the color of the ink forming portion 24. When the halo-defining portion is yellow, a darker contrasting color such as pink, brown, red or orange may be used. Various other second colors may be utilized for the transitional target indicia in accordance with this invention. Moreover, as is described more fully below, in certain embodiments, the transitional target indicia may comprise a negative printed image and the front surface 14 of target base 12 may effectively define the color of the transitional target indicia. In any event, the transitional target indicia should feature a readily discernible color.

Figure 2C:
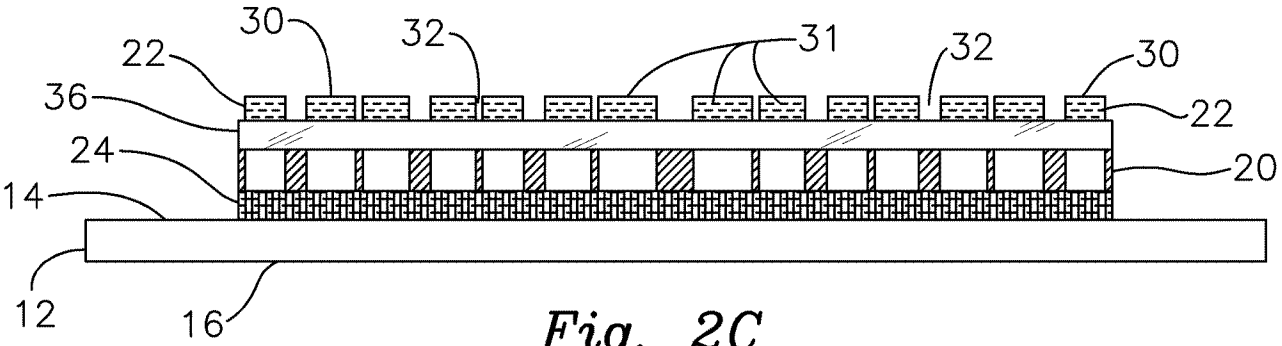
FIG. 2C is a side, cross sectional fully assembled impact marking target of FIG. 1 incorporating the target base as shown in FIG. 2B, as well as an exterior target image and transparent film which are applied over the target base and interposed transitional target image.
Figure 5:
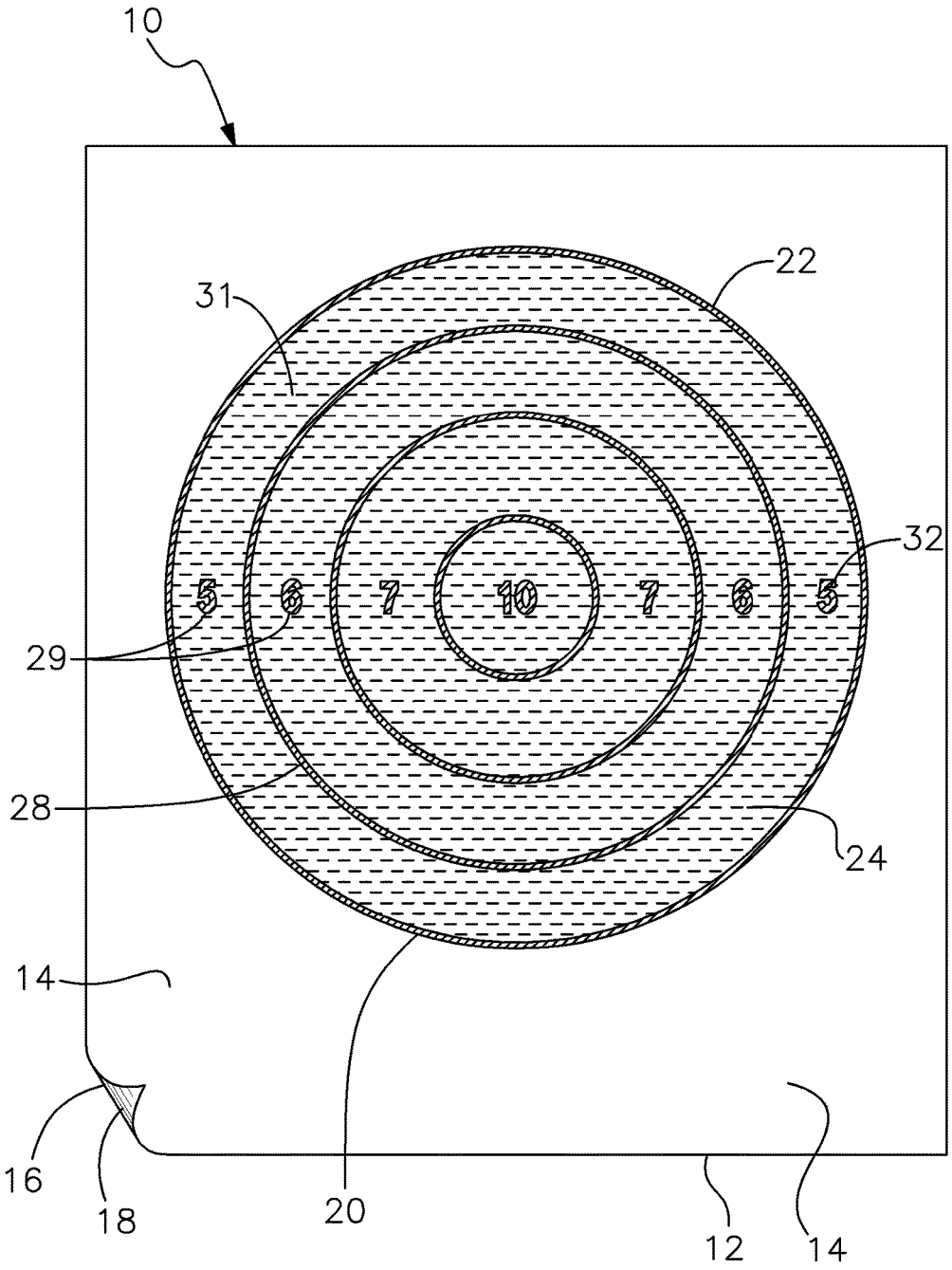
FIG. 5 is an elevational front view of a fully assembled impact marking target that employs the exterior and transitional target images of FIGS. 3 and 4, which are combined and integrated in accordance with this invention.

After the transitional target image is applied to and integrated with base 12, an exterior impact marking target image is applied to the target base over the transitional target image in the manner shown in FIGS. 1, 2C and 5. Specifically, a thin, optically transparent plastic film is applied over and adhered to base 12 and the transitional target image printed thereon. Film 36 preferably includes a transparent layer of bi-axially oriented polypropylene or similar plastic film having a pressure sensitive rubber or acrylic base adhesive backing. Other low dyne plastic films such as polyethylene, poly acrylic, Mylar and similar films may be substituted for polypropylene in all versions of this invention. Because laminated film layer 36 is optically transparent, it serves as a window and allows the halo-defining portion 24 and transitional target indicia 28 and 29 to be exposed through film 36 after a projectile strikes the target. The film layer also locks the underlying transitional target image in place on base 12.

An optional release agent, not shown, may be applied over film 36, as further described in U.S. Pat. Nos. 5,580,063 and 8,596,643. In various embodiments, the release layer may be omitted. The use of an optional additional release agent provides a means whereby the size of the halo produced by the projectile impact can be increased or decreased in size to compensate for manufacturing tolerances, thereby maintaining uniformity and performance and producing consistent results. This inclusion of this optional element is left to the sole discretion of the individual target manufacturer.

Figure 4:
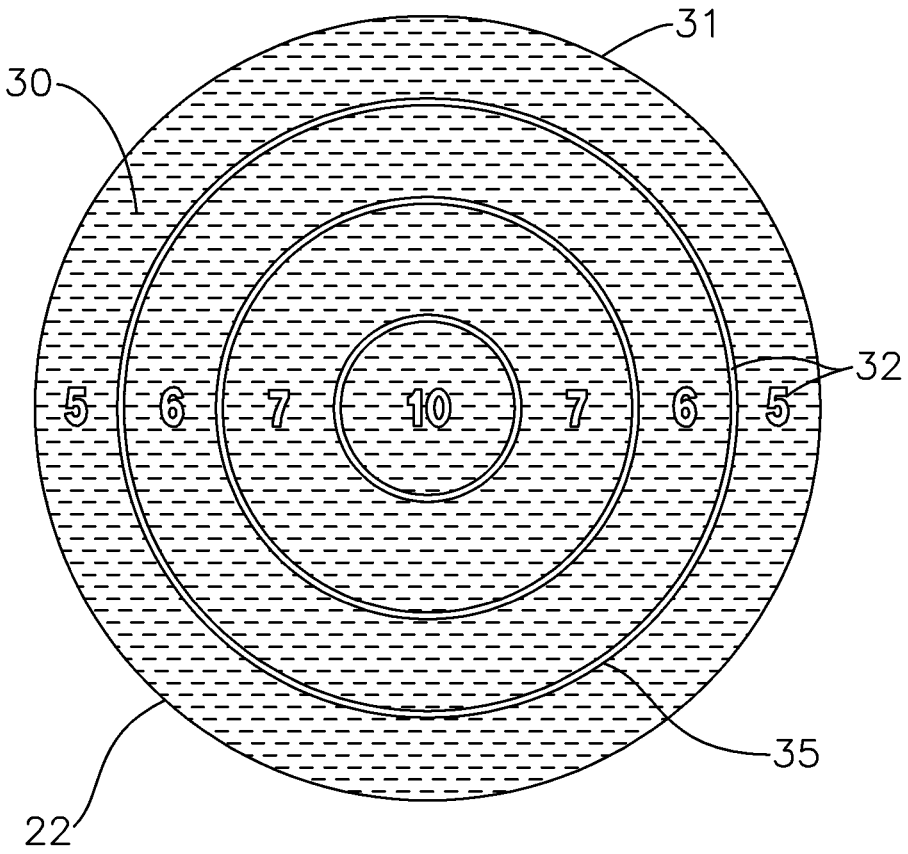
FIG. 4 is an elevational front view of an exterior target image of the type employed in standard projectile impact marking targets and which may be applied over the transitional target image of FIG. 3.

After the film is applied over the transitional target image, the exterior target image 22 is printed onto a top surface of the film 36 as shown in FIGS. 1, 2C and 5 utilizing a layer of displaceable ink 31 applied to the film layer. As shown in FIGS. 1 and 4, the standard color scheme for ink 31 of exterior target image 22 is traditionally, but not limited to, black or an otherwise suitable third color (e.g. gray or silver) that provides for a significant contrast with the first color of the underlying halo-defining portion 24, shown in FIGS. 1 and 3. Moreover, the exterior target image should otherwise be devoid of the reflective or highly visible first color to enable the halo or corona to be clearly discernible when a projectile strikes the target. As shown in FIG. 4, target image 22 includes a series of discrete segments 30, including bullseye 10 and annular scoring segments 5, 6 and 7 separated by a series of thin concentric rings 35. These rings and the scoring numerals 5, 6, 7, and 10 comprise exterior target indicia 32 which mark the discrete segments 30 of exterior target image 22. More particularly, exterior target image 22 and ink 31 are printed on top of film 36 such that the exterior target indicia 32 are formed as negative images or holes through the black or alternatively colored displaceable ink 31 of image 22. Because the exterior target indicia 32 are aligned with the underlying transitional target indicia 26, the underlying indicia 26 are exposed through the holes forming the exterior target indicia image and the second color of the transitional target indicia (e.g. pink, brown, red or orange) is exposed through the exterior target image. Preferably, this second color also contrasts with the third color of displaceable ink 31 so that the numerals and rings of the bullseye are easy for the shooter to see.

In alternative embodiments the numerals and rings comprising exterior target indicia 32 may include ink that is applied as a positive image to ink layer 31. In such cases the indicia 32 should also include a displaceable ink that contrasts in color with ink 31. In the positive image versions, the exterior and transitional target indicia may include like, different or contrasting colors within the scope of the invention. It should also be understood that exterior ink layer 31 may include a color that is either the same as or different from the color of the transitional target indicia 26. In other words, the second and third colors referred to herein may be either matching or contrasting in accordance with this invention. The first and third colors must, in any event, contrast to provide the desired halo effect.

Figure 6:
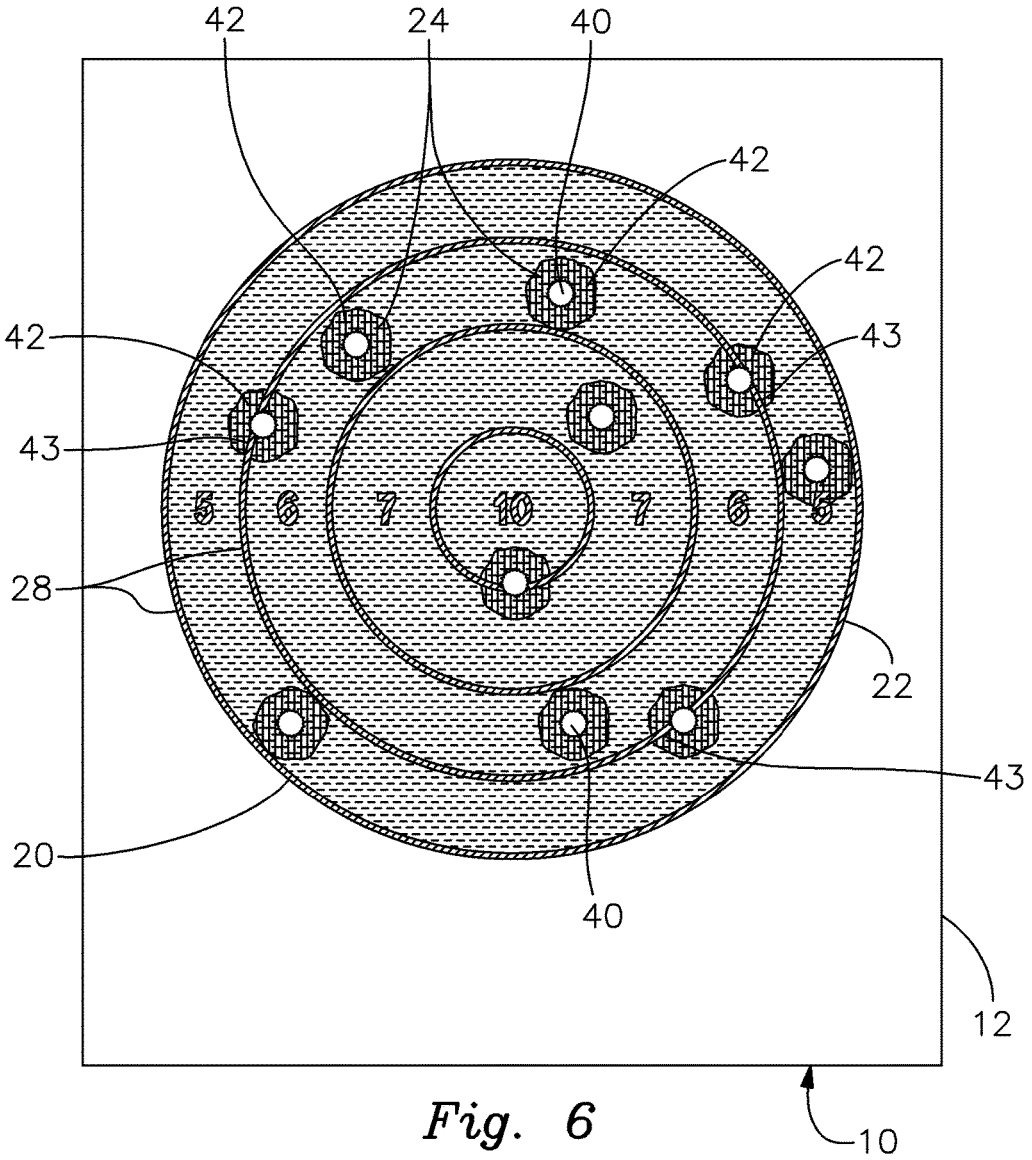
FIG. 6 is an elevational front view of the fully assembled impact marking target in accordance with FIG. 1-5, with ballistic projectile impacts and penetrations illustrated thereon; the resultant "halo" or "corona" effect reveals the transitional target indicia within the area surrounding each projectile's penetration hole such that the impact location relative to the exposed transitional target indicia is accurately marked.
Figure 6A:
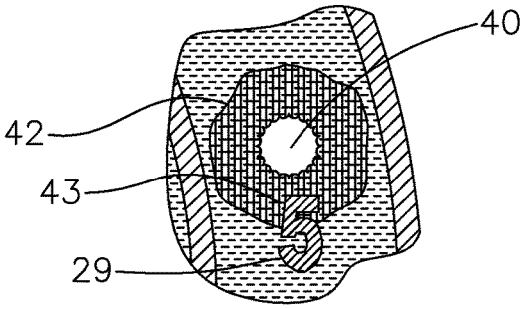
FIG. 6A is a fragmentary view of FIG. 6 with a portion of a representative numeric transitional indicia exposed within an impact halo.

The assembled impact marking target 10, shown in FIG. 5, may be employed to accurately record projectile strikes in the manner shown in FIGS. 6 and 6A. As each bullet or other projectile strikes target 10 it creates an impact hole 40. The black dislodgeable ink of exterior target image 22 dislodges from the target in the area surrounding each projectile hole 40. If positive image exterior target indicia are used, the ink comprising the exterior target indicia may also be removed by projectile impact. This creates a halo 42 that exposes the underlying highly visible color of halo-defining portion 24. The corresponding underlying portion of previously hidden transitional target image 20, FIGS. 1 and 3, thereby transitions from the hidden condition to an exposed condition surrounding its respective projectile impact hole 40. By the same token, any segment 43 of transitional target indicia 28 and 29, which either intersects the projectile hole 40 or is otherwise within the corresponding exposed halo 42, is also clearly visible within the halo. Because the transitional target indicia 26 are permanently bonded to the halo-defining portion 24, the underlying indicia segments 43 remain clearly displayed and visible through respective halos 42 even if corresponding and matching indicia carried by the exterior target image have been obliterated by the projectile impact. The precise location of a projectile strike may thus be quickly and accurately discerned and calibrated.

It should be understood that the graphics comprising the revealed transitional target indicia may be composed of, but are not restricted to a combination of colors, shading and/or a reverse (negative image) effect. All such images will be visible within the halo 42 produced by the projectile impact. Nonetheless, it is critical that the halo-defining portion of the transitional target image feature a color that is not present in the exterior target image so that a clearly visible halo will be produced when the target is impacted.

Figure 7:
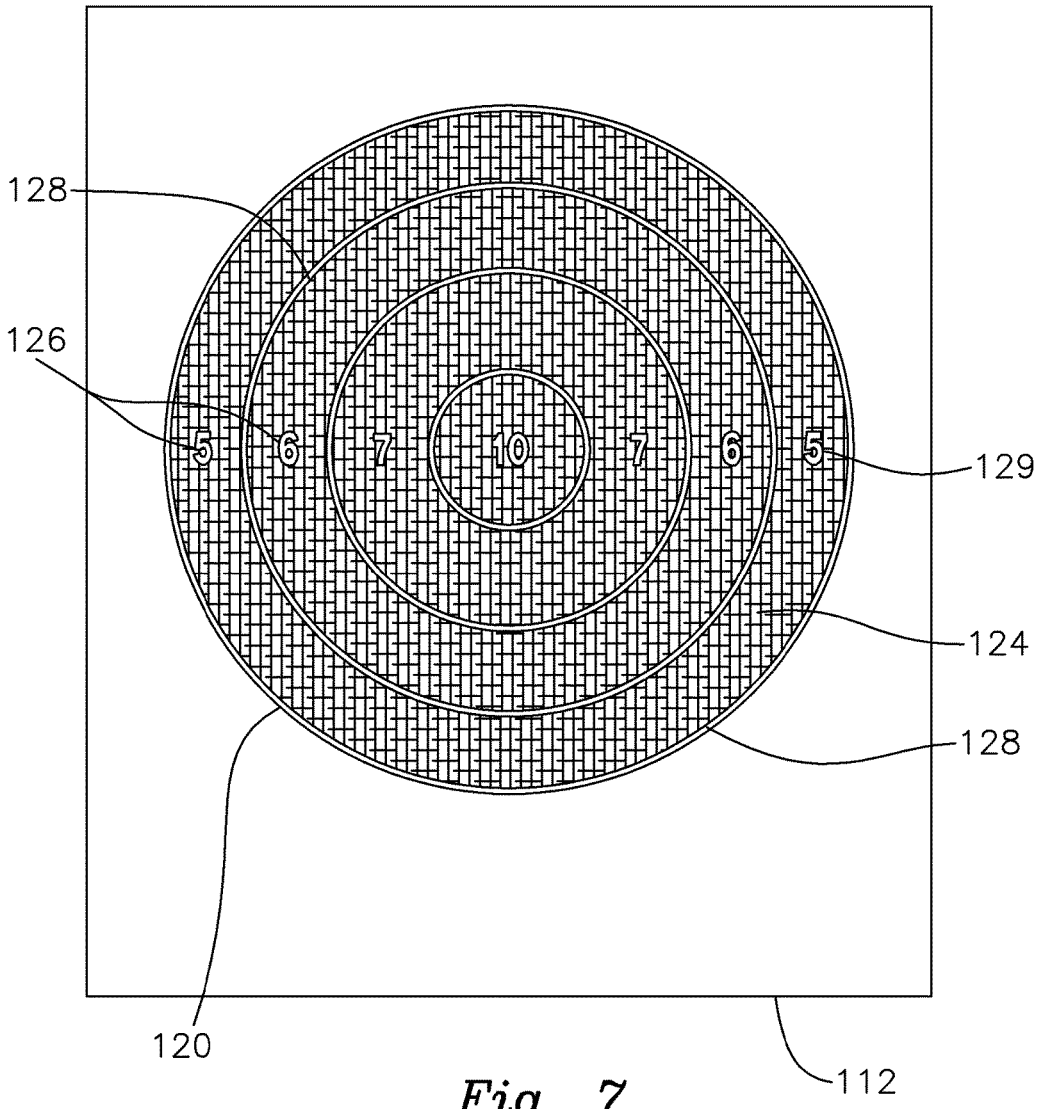
FIG. 7 is a view similar to FIG. 3 but with the transitional target base and target indicia formed as a negative image.
Figure 8:
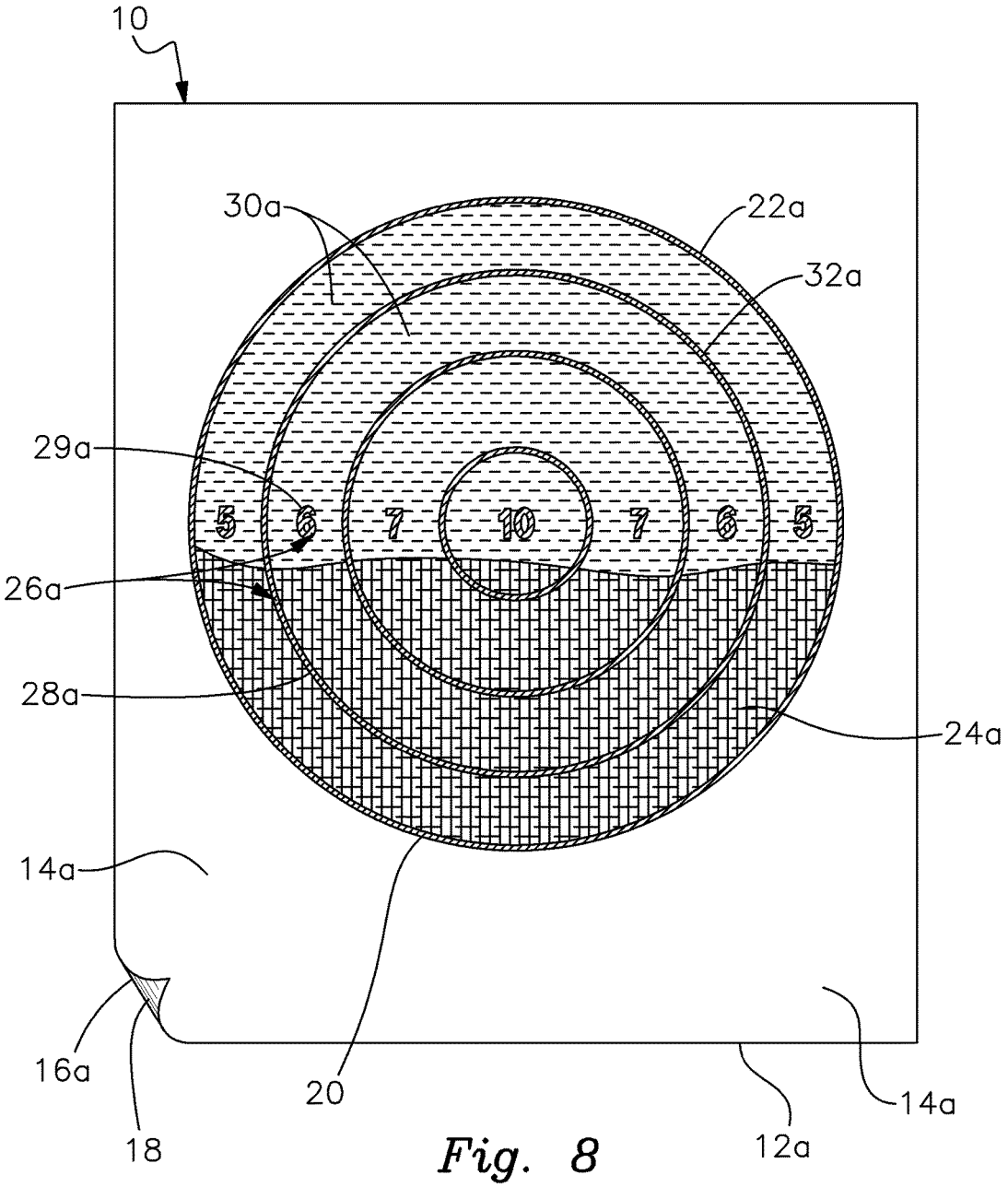
FIG. 8 is an elevational front view of an alternative second impact marking target having matching transitional and exterior target images formed thereon in accordance with this invention with a transparent film layer interposed between the halo-defining portion and the transitional target indicia; the exterior target image is partially cut away to illustrate the underlying transitional target image printed on the target base.

FIG. 7 depicts an alternative transitional target image 120 as applied to a base 112. In this version, a base coat 124 is utilized to form a negative image, wherein highly visible (e.g. yellow) rings are formed about indicia 126, which again comprise numerals 129 and rings 128 marking discrete segments of the transitional target image. In this version high visibility print ink 124 is applied to target base 112 in discrete annular bands to form the halo-defining portion, rather than as a continuous base coat to which the transitional target indicia are applied as described above. As a result, production of the base is somewhat more complicated and less efficient than in the version shown in FIGS. 1-3. Nonetheless, the negative or reverse transitional target shown in FIG. 7 image can be used within the scope of this invention.

FIGS. 8-14 depict an alternative preferred impact marking target 10*a*, including a base 12*a*. The base includes a front surface 14*a* and a rear surface 16*a*, which is manufactured in a manner analogous to that used for the previously described embodiment. Front surface 14 of base 12 supports a transitional target image 20*a* and a corresponding exterior image 22*a* comprising a conventional impact dislodgeable ink. Transitional target image 20*a* includes a halo-defining portion 26*a* composed of a highly visible and preferably reflective first color such as fluorescent yellow. The transitional target image also includes transitional target indicia 26*a*, which comprise the annular lines 28*a* defining the rings of the bullseye image and the collective numerals 29*a* that designate the respective discrete regions of the bullseye. Once again, those regions are marked by respective numerals 5, 6, 7 and 10 representing the concentric annular regions and bullseye of the target.

Exterior target image 22*a* again features a concentric series of annular regions 30*a* that are defined by a removable or dislodgeable black ink. Exterior target image 22*a* also features numerals 5, 6, 7 and 10 (collectively designated as indicia 32*a*) that correspond positionally with the underlying rings 28*a* and numerals 29*a*, respectively, of transitional target image 20*a*. Transitional target image 20*a*, which is shown mounted to target base 12*a* in FIG. 10, includes one or more ink print coats 24*a* comprising, but not limited to, yellow or another highly visible color, preferably in the fluorescent spectrum zone. This forms a halo-defining portion 24*a*. Yellow is preferred due to its high degree of photoreflectivity and visibility, which again makes it particularly effective for use in ballistic target practice and shooting competitions. The halo-defining portion may be otherwise permanently bonded to the underlying surface of 14*a* of target base 12*a* in the manner previously described.

Figure 9A:
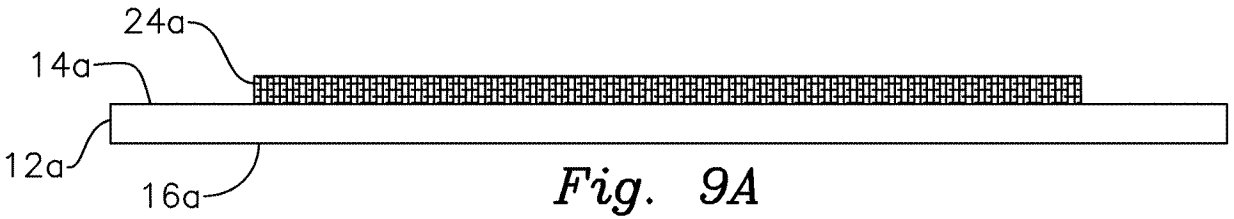
FIG. 9A is a side, cross sectional view of the target base of the version of FIG. 8 with a print coat layer comprising a highly visible first color forming a halo-defining portion that is bonded to the base.
Figure 9B:
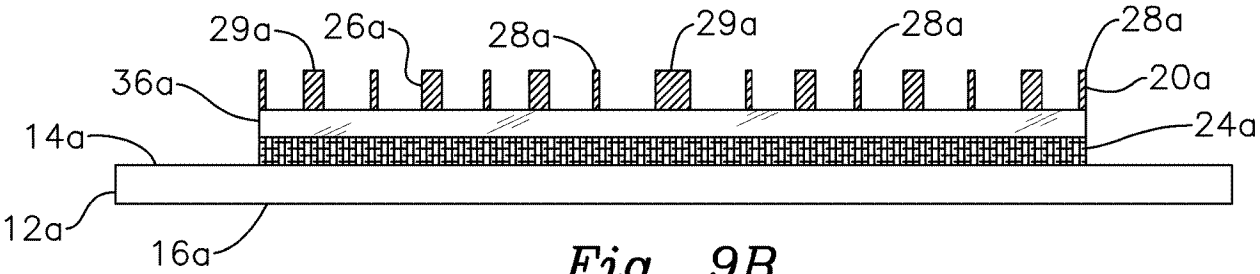
FIG. 9B is a side cross sectional view of the target base of FIG. 8 with the transitional target image applied to the front surface of the base and with a transparent film interposed between and permanently bonded to the halo-defining portion and the transitional target indicia of the transitional target image.
Figure 9C:
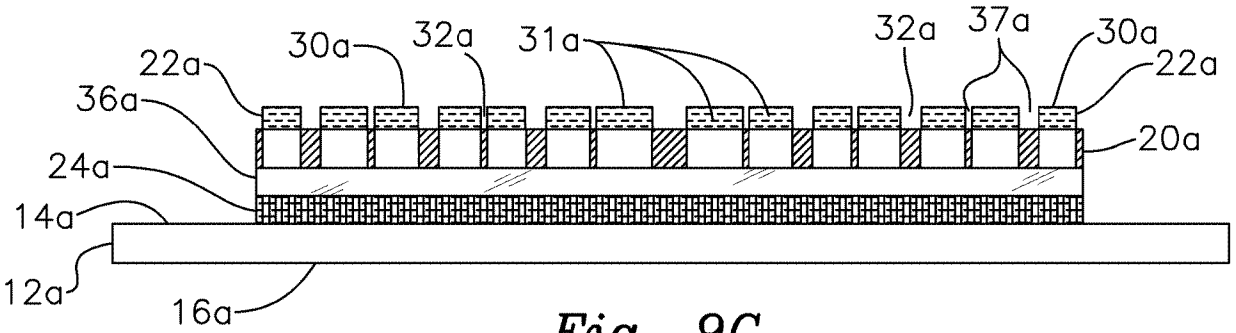
FIG. 9C is a side, cross sectional fully assembled impact marking target of FIG. 8.
Figure 10:
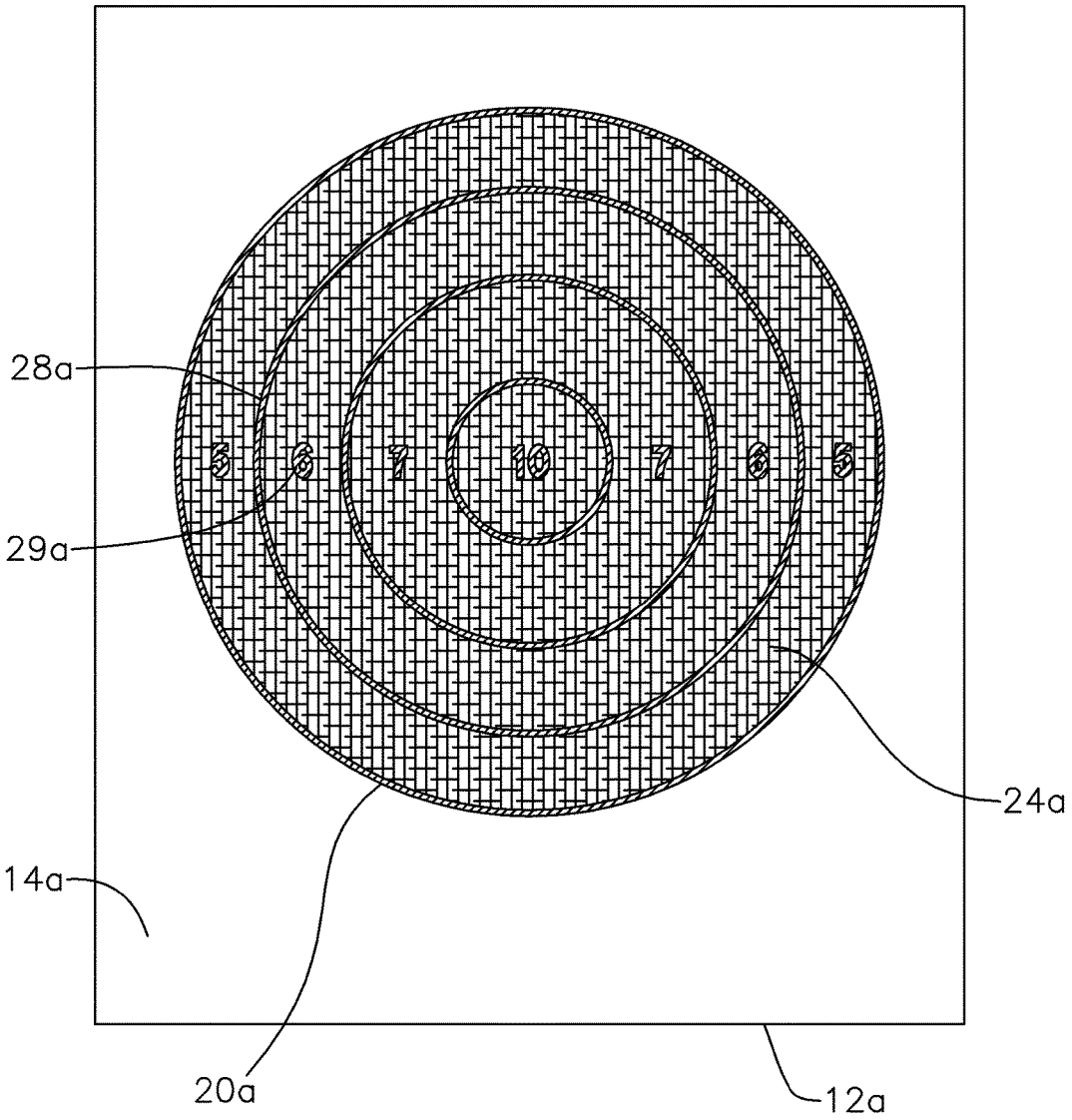
FIG. 10 is an elevational front view of the target base of FIG. 8 with the transitional target image and the transitional target indicia shown as a positive image.

After halo-defining portion 24*a* is applied to the front surface of base 12*a*, a thin, transparent, low dyne film layer 36*a*, FIGS. 9*b* and 9*c* is applied over the halo-defining portion. Film 36*a* may be composed and applied over halo-defining portion 24*a*, as described in connection with the previous embodiment.

After transparent film 36*a* is applied, transitional target indicia 26*a* are printed or otherwise permanently bonded on the upper surface of film 36*a* in the manner shown in FIGS. 9*b* and 9*c*. Specifically, annular lines 28*a* and numerals 29*a* are printed on the top or outer surface of film 36*a* such that lines 28*a* and numerals 29*a* are clearly visible against halo-defining portion 24*a*. Indeed, rings 28*a* and numerals 29*a* should include a color that clearly contrasts with the underlying halo-defining portion. When the halo-defining portion is yellow, a darker contrasting color such as red, pink or orange may be used. Various other colors may be used for the transitional target indicia in accordance with this invention. Preferably, a durable and non-removable high quality ink consistent with the operating specifications of the printing equipment producing the graphic image is employed for the transitional target indicia in this embodiment. In certain embodiments, the transitional target indicia may alternatively comprise a negative printed image and the front surface 14*a* of target base 12 may effectively define the second color of the transitional target indicia, which must contrast with the first color of the halo-defining portion. In any event, the transitional target indicia should feature a readily discernible contrasting color against the halo-defining portion.

Film layer 36*a* serves to satisfactorily support and bond to the non-dislodgeable ink typically comprising the transitional target indicia. Because film 36*a* is optically transparent, it also serves as an effective window for exposing the halo-defining portion 24*a* after a projectile strikes the target. Film layer 36*a* also locks the halo-defining portion in place on base 12.

Figure 11:
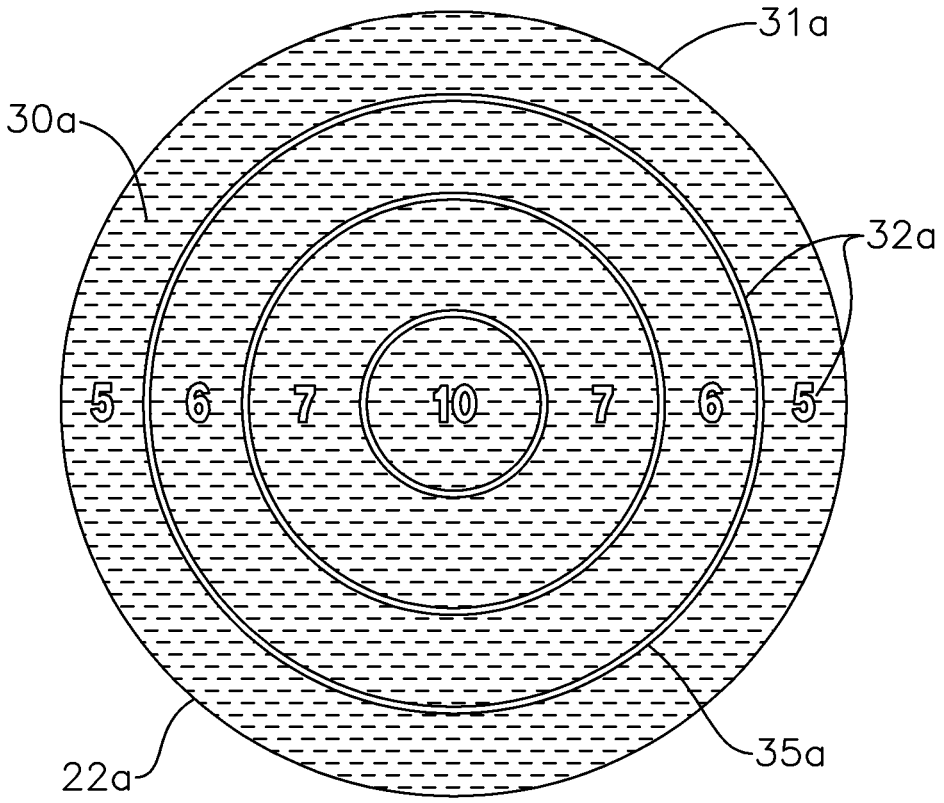
FIG. 11 is an elevational front view of an exterior target image of the type employed in standard projectile impact marking targets and which may be applied over and on top of the transitional target image of FIG. 10.

After the transitional target indicia 26*a* are applied over film 36*a*, the exterior target image 22*a* is printed directly on top of transitional target indicia 26*a* as shown in FIGS. 9*b*, 9*c* and 11. In particular, a layer of displaceable ink 31*a* is applied to the film layer. The color scheme for ink 31*a* of exterior target image 22*a* is traditionally, but not limited to black or an otherwise suitable third color (e.g. gray or silver) that provides for a significant contrast with the first color of the underlying halo-defining portion 24*a*. Target image 22*a* also includes a series of discrete segments 30*a*, including bullseye 10 and annular scoring segments 5, 6, and 7. These rings and scoring numerals comprise exterior target indicia 32*a*, which mark the discrete segments of exterior target image 22*a*. More particularly, exterior target image 22*a* and ink 31*a* are printed directly on top of transitional target indicia 26*a* such that the exterior target indicia 32*a* are formed as negative images or openings through the black displaceable ink 31*a* of image 22*a*. Because the exterior target indicia 32*a* are aligned with the underlying transitional target indicia 26*a*, the transitional target indicia are exposed through the openings 32*a* forming the exterior target indicia and the contrasting second color of the transitional target indicia (e.g. red, pink or orange) is exposed through the exterior target image 22*a*. This second color should also contrast with the third color of displaceable ink 31*a* so that the numerals and rings of the bullseye are easy for the shooter to see. Moreover, the exterior target image should again be devoid of the highly visible first color to enable the halo or corona to be clearly visible in this case when a projectile strikes the target.

In alternative embodiments the numerals and rings comprising exterior target indicia 32*a* may include ink that is applied as a positive image to ink layer 31*a*. In such cases the indicia 32*a* should also include a displaceable ink that contrasts in color with ink 31*a*. In the positive image versions, the exterior and transitional target indicia may include like, different or contrasting colors within the scope of the invention. It should also be understood that exterior ink layer 31*a* may include a color that is either the same as or different from the color of the transitional target indicia 26*a*. In other words, the second and third colors referred to herein may be either matching or contrasting in accordance with this invention. The first and third colors must, in any event, contrast to provide the desired halo effect.

Figure 12:
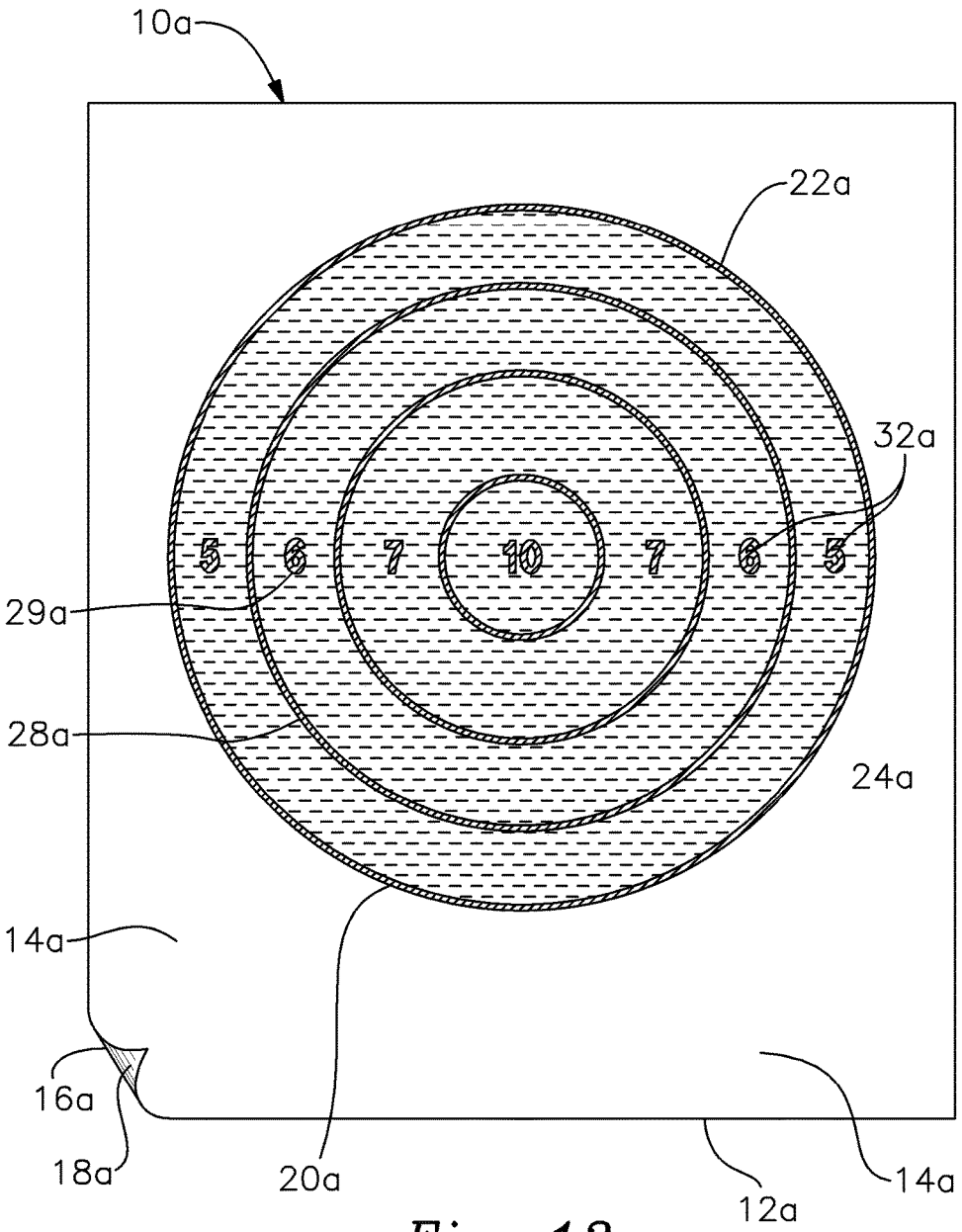
FIG. 12 is an elevational front view of a fully assembled impact marking target of FIG. 8 that employs the exterior and transitional target images which are combined and integrated in accordance with this invention and wherein the target includes an optional adhesive backing.
Figure 13:
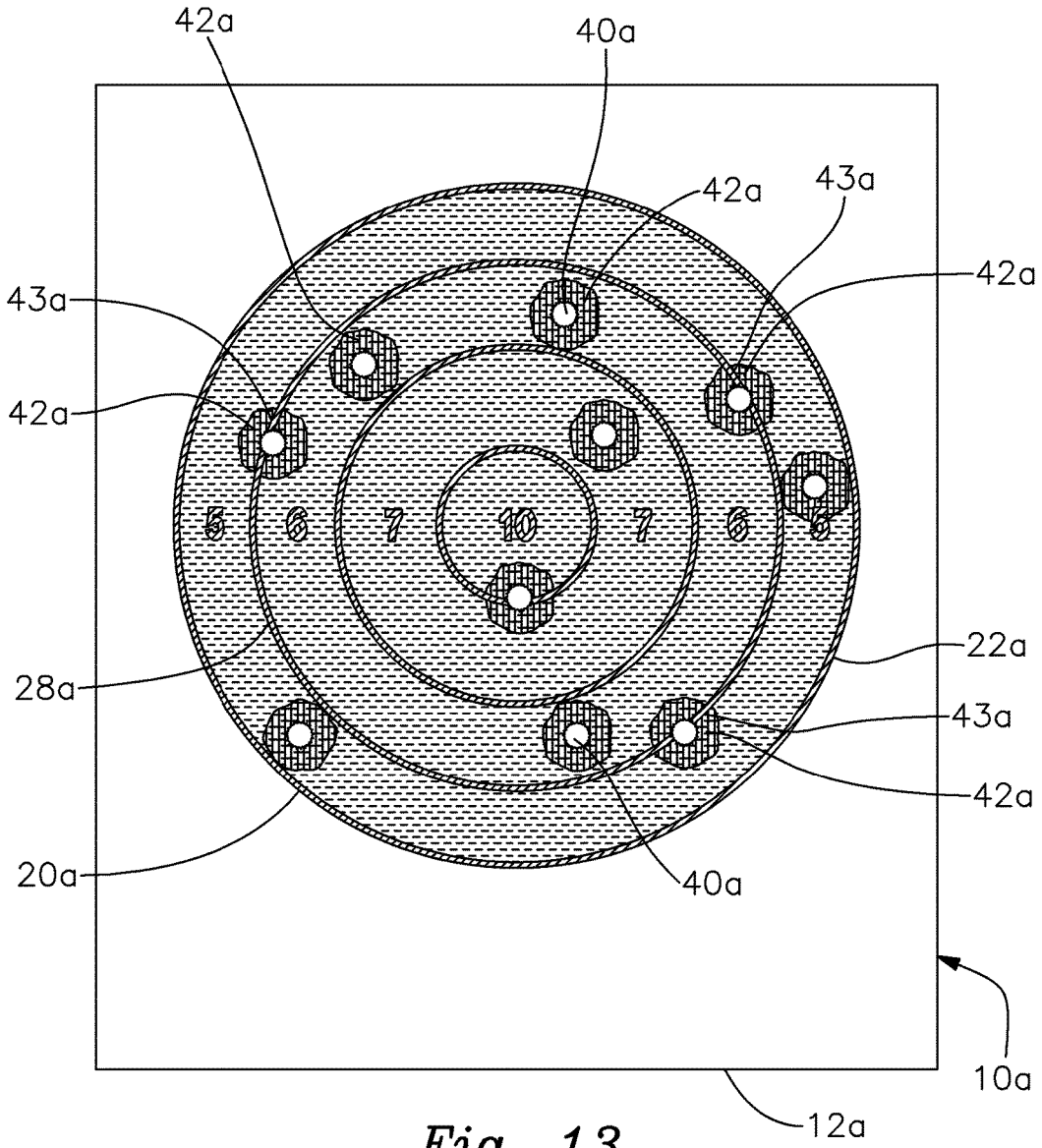
FIG. 13 is an elevational front view of the fully assembled impact marking target in of FIG. 8 with ballistic projectile impacts and penetrations illustrated thereon; the resultant "halo" or "corona" effect reveals the transitional target indicia within the area surrounding each projectile's penetration hole such that the impact location relative to the exposed transitional target indicia is accurately marked.
Figure 13A:
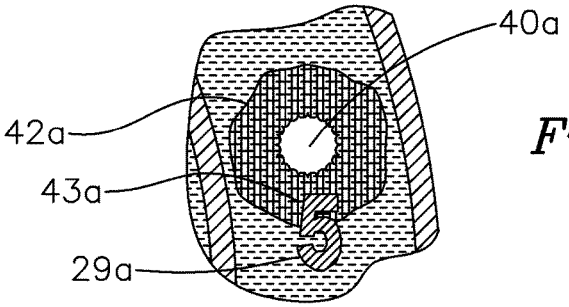
FIG. 13A is a fragmentary view of FIG. 13 with a portion of a representative numeric transitional indicia exposed within an impact halo.
Figure 14:
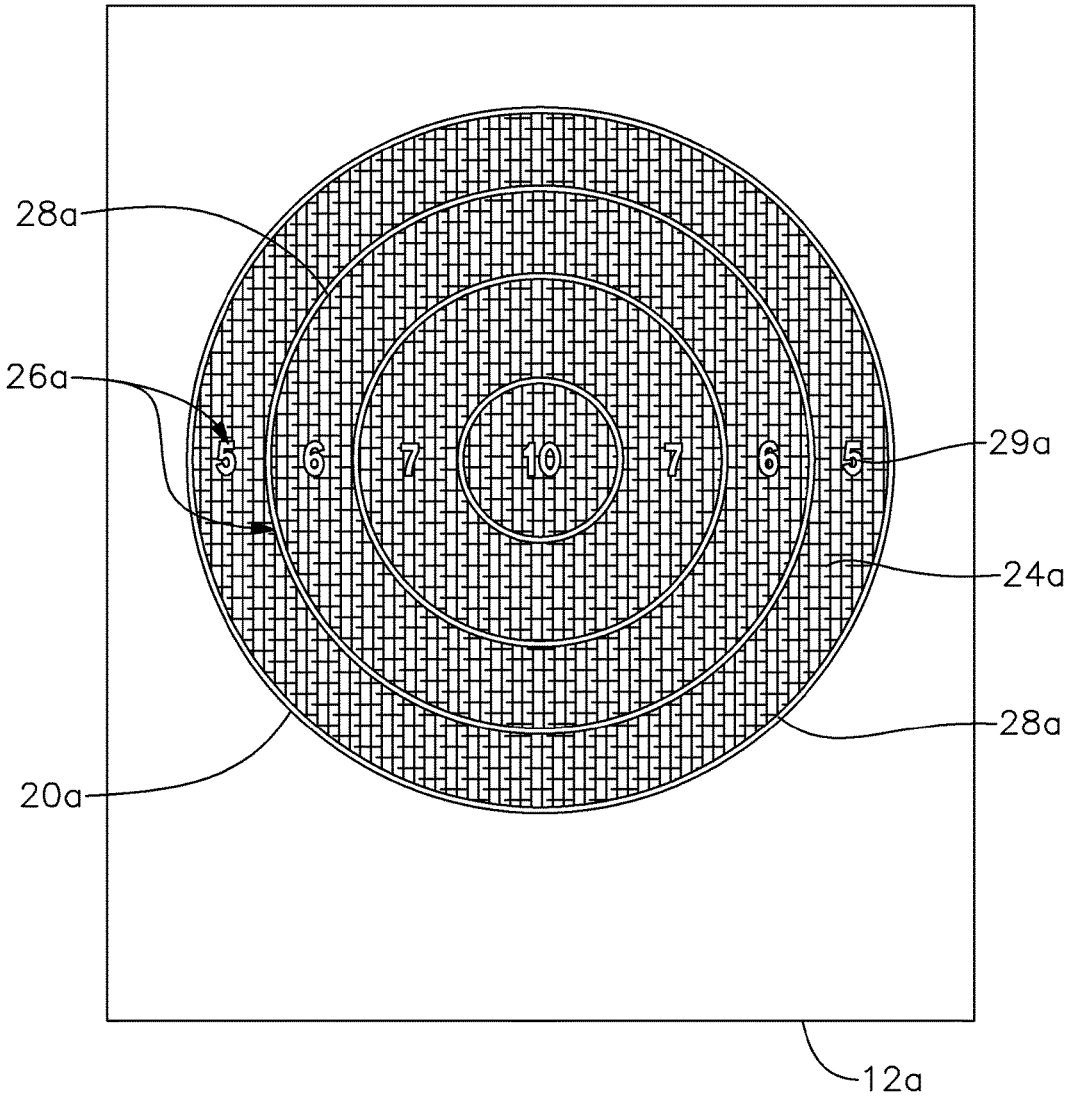
FIG. 14 is a view similar to FIG. 10 but with the transitional target base and target indicia formed as a negative image.

The assembled impact marking target 10*a*, shown in FIG. 12, may be employed to accurately record projectile strikes in the manner shown in FIG. 13. As each bullet or other projectile strikes target 10*a* it creates an impact hole 40*a*. The black dislodgeable ink of exterior target image 22*a* dislodges from the target in the area surrounding each projectile hole 40*a*. If positive image exterior target indicia are used, the ink comprising the exterior target indicia may also be removed by projectile impact. This creates a halo 42*a* that exposes the underlying highly visible color of halo-defining portion 24*a*. The corresponding underlying portion of previously hidden transitional target image 20*a*, FIGS. 1 and 3, thereby transitions from the condition wherein the halo-defining portion is hidden by the displaceable ink to an exposed condition surrounding its respective projectile impact hole 40*a*. By the same token, any segment 43*a* of transitional target indicia 28*a* and 29*a*, which either intersects the projectile hole 40 or is otherwise within the corresponding exposed halo 42*a*, is also clearly visible against the halo. Because the transitional target indicia 26*a* are permanently bonded to the halo-defining portion 24*a*, the underlying indicia segments 43*a* remain clearly displayed and visible through respective halos 42*a* even if corresponding and matching indicia carried by the exterior target image have been obliterated by the projectile impact. The precise location of a projectile strike may thus be quickly and accurately discerned and calibrated. Again, it is critical that the halo-defining portion of the transitional target image feature a color not present in the exterior target image so that a clearly delineated and halo will be produced when the target is impacted by a projectile.

I have further discovered that unexpected superior results are achieved by placing transitional image indicia onto the outer surface of the transparent film. The advantages of that alternative protocol are as follows. The transitional target, indicia and accompanying displaceable ink exterior target image can be applied sequentially, during a single pass through the operating cycle of the printing press. A flexographic type printing press is especially preferred. A second advantage to the embodiment of FIGS. 8-14 is that the transitional and displaceable image indicia will be more closely registered together without an intervening film. It is easier and more cost effective to achieve such registration during a single pass through the printing press instead of applying the film layer between the transitional and exterior image indicia layers. An additional benefit from the second version of this invention results when the completed target is subjected to actual range use under operational conditions. As the projectile impacts the target, it leaves a penetration hole. This stretches the polypropylene film, which is directly impacted by the projectile. I have determined that, although there is a propensity for the polypropylene film to stretch, the adhesion of the polypropylene film upon the front surface of the target base is sufficient to minimize the degree of film distortion, and accordingly the pro rata stretch factor of graphic transitional indicia printed on, and attached to the outer surface of the film. This phenomena results in minimal image distortion of the transitional indicia graphics positioned on the outer surface of the polypropylene film. In fact, the distortion of both the film, and the printed image will be in equilibrium. The transitional target indicia are distorted far less than in versions where the film is applied over the front of the transitional target indicia. Therefore, following impact, the shooter will still be able to accurately determine the precise location of the projectile's impact with reference to any remaining projectile impact referencing indicia on the target.

In accordance with the foregoing principles, it is beneficial for an exterior calibration coordinate target indicia image to be applied onto the outer surface of the polypropylene film over the halo-defining target indicia portion. The final transitional target indicia can then be printed utilizing a permanent non-detachable type ink, which will conform to the standards and specifications relative to the calibration graphic media selected, or which corresponds to the interpretation of a given graphic design style. The target image can include but is not restricted to alpha or numeric coordinate matrixes, a graphic design consisting of positive or negative images which may include conventional and traditional target designs, wildlife animal profile targets or even anatomical targets for military, or police training. The exterior target image is the final image to be printed and is positioned over, on top of, and registered to the transitional graphic image. The images are preferably substantially accurately aligned and congruent with one another. The exterior target image incorporates a dislodgeable ink portion having a third color that contrasts with the first color of the target base flood coat and graphically complements the transitional target image consistent with the graphic design chosen. The exterior target image further includes exterior, target indicia that preferably positionally correspond or register with the transitional target indicia. As a result, the projectile striking the completely assembled impact marking target produced in accordance with the foregoing teachings thereby removes the dislodgeable ink of the exterior target image adjacent to the point that the projectile impacts the exterior target image. This clearly and effectively exposes an underlying portion of the transitional target image and displays any transitional target indicia within that underlying portion.

In the embodiments described herein, an outer transitional indicia ring 28, 28*a* is formed in an exposed region circumferentially surrounding the displaceable ink forming the exterior target image. As used herein, "exterior target indicia" should be understood to include this circumferentially exposed region through which the outer ring 28, 28*a* is exposed. This outer transitional indicia ring facilitates the marking of projectile impacts along the outer edge of the target. In alternative embodiments, the dislodgeable ink of the exterior target image may extend outwardly to completely cover and hide the outermost ring of the transitional indicia. In still other versions, an outermost thin transitional indicia ring, which surrounds the halo-defining portion 24, 24*a* may be omitted. Nonetheless, such an outer circumferential ring 28, 28*a* having the second color improves the discernability, marking and accurate recording of projectile impacts that occur along the outer circumference of the target.

FIGS. 1-14 depict representative examples of various ways that the transitional target indicia may be designed in accordance with of this invention. Other designs may also be employed. The transitional target indicia may comprise either positive or negative images or a combination of both. They may also include various types and combinations of alpha numeric symbols, colors, shading and other coordinates or graphic representations. Preferably, the graphic design that is utilized must enable multiple projectile impacts to be compared and calibrated in a quick and effective manner for use in marksmanship shooting competitions. Furthermore, the transitional target indicia should be printed so that they are as unobtrusive as possible and cause minimal if any degradation of the halo effect. This avoids a loss in visual clarify for marksmen shooting across longer distances.

The present invention greatly improves the accuracy of calibrating and measuring ballistic strikes in various shooting competitions. It also is a useful training and practice aid for military, police and security personnel. The transitional target image may be incorporated into existing impact marking target technology with very few additional production steps and minimal attendant cost. The inks that may be employed for the transitional target base may be varied within the scope of this invention and selected according to the manufacturer's printing requirements. These specifications will typically be determined by the requirements and specifications of the printing press operating protocol and ink curing system that is used by the manufacturer. Preferably, a non-displaceable, high quality ink with permanent curing characteristics should be selected for the transitional target to form the transitional target image. It is particularly important that the image bond effectively and permanently on the surface of the target base. The transitional target indicia may be designed in various alternative ways for either version of this invention.

In addition to the use of conventional inks, there are a large number of sophisticated and highly specialized printing inks which have properties of special interest to a variety of military and law enforcement agencies. These exotic inks include, but are not limited to, ultra violet and infra red inks, all of which are highly adaptable for use in conjunction with the ballistic projectile target base with the transitional target image. Incorporating such inks into the invention would allow the end user to optimize marksmanship under various adverse conditions that may pertain to the respective agencies and activities that utilize this technology.

The transitional target image and the exterior target image may be, but are not necessarily identical in size, configuration and nature. Alternative formats may be employed wherein the transitional target image features graphic representations that vary somewhat from those of the exterior target image.

In certain versions, the transitional and/or exterior target indicia may include inks having a plurality of second colors that contrast with both the first and third colors. For example, the indicia defining the thin annular rings described herein may be colored differently than the numerals that represent the score of a particular target segment. In all cases the first, second and third color should clearly contrast with one another and the exterior target image should totally lack the first color.

Accordingly, the present invention provides for an improved impact marking target and, more particularly, a ballistic projectile target base with a unique transitional target image as well as a method for manufacturing such products.

While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. An impact marking target device comprising:

a base having front and back surfaces;

a transitional target image carried by said front surface of said base, said transitional target image including a halo-defining portion that has a highly visible first color and transitional target indicia including a first negative image formed in said halo-defining portion and a second color that contrasts with said first color and is formed against said base within said first negative image for marking discrete regions of said transitional target image, said transitional target image including at least one ink that consists of a non-dislodgeable permanent ink;

a transparent film having a top surface applied over said front surface of said halo-defining portion such that said transitional target image is interposed between said base and said film; and an exterior target image applied to said top surface of said film, said exterior target image consisting of a dislodgeable ink having a third color that contrasts with said first color and exterior target indicia for marking discrete regions of said exterior target image, said exterior target indicia consisting of a second negative image formed in said dislodgeable ink and being registered with said first negative image to expose said second color of said transitional target indicia therethrough, said exterior target image being devoid of said first color, whereby a projectile striking said target removes said dislodgeable ink of said exterior target image around a point of impact on said exterior target image, which exposes a portion of said transitional target image including any said transitional target indicia within said exposed portion of said transitional target image.

2. The device of claim 1 in which said base includes a pressure sensitive label that carries an adhesive on the back surface thereof.

3. The device of claim 1 in which said transitional target indicia and said exterior target image each comprise a graphic design including at least one of a bullseye, concentric rings surrounding a bullseye and alphanumeric indicia.

4. The device of claim 1 in which said halo-defining portion is defined by a print coat carried by said front surface of said base, said transitional target indicia being applied over said print coat.

5. The device of claim 1 in which said transitional target indicia further include a non-dislodgeable permanent ink formed against said base and exposed through said registered first and second negative images of said transitional target indicia and exterior target indicia.

6. The device of claim 3 in which each of said transitional target indicia and said exterior target indicia consists of at least one of coordinates and alphanumeric symbols.

7. An impact marking target device comprising:

a base having front and back surfaces;

a transitional target image carried by said front surface of said base, said transitional target image including a halo-defining portion applied to said front surface of said base and having a highly visible first color, a transparent film having a bottom surface applied over said halo-defining portion and transitional target indicia carried by an upper surface of said transparent film and juxtaposed with said halo-defining portion, said transitional target indicia being devoid of said first color and having a second color that contrasts with said first color for marking discrete regions of said transitional target image; each of said halo-defining portion and said transitional target indicia consisting of a respective non-dislodgeable permanent ink that remains attached to said base around a point of projectile impact on the transitional target image; and an exterior target image applied over said transitional target image, said exterior target image including a layer of dislodgeable ink having a third color that contrasts with said first color and exterior target indicia formed in said dislodgeable ink and registered with at least a portion of said transitional target indicia for marking discrete regions of said exterior target image, said exterior target image being devoid of said first color, whereby a projectile striking said target removes said dislodgeable ink of said exterior target image around a point of impact on said exterior target image, which exposes a portion of said transitional target image including any said transitional target indicia within said exposed portion of said transitional target image.

8. The device of claim 7 in which said transitional target indicia include a positive image having said second color.

9. The device of claim 8 which said exterior target indicia include a negative image in said dislodgeable ink that is registered with said transitional target indicia to expose said transitional target indicia through said negative image of said exterior target image.

10. The device of claim 7 in which said transitional target indicia and said exterior target image respectively comprise a graphic design including at least one of a bullseye, concentric rings surrounding a bullseye and alphanumeric symbols.

11. The device of claim 7 which said transitional target indicia include a positive image juxtaposed with said halo-defining portion.

12. The device of claim 7 in which said exterior target image includes a negative image formed in said dislodgeable ink that registers with at least a portion of said transitional target indicia.

13. The device of claim 7 in which said base includes a pressure sensitive label that carries an adhesive on the back surface thereof.

14. The device of claim 10 in which each of said transitional target indicia and said exterior target indicia consists of at least one of coordinates and alphanumeric symbols.

* * * * *